US006464819B1

(12) United States Patent
Sette et al.

(10) Patent No.: US 6,464,819 B1
(45) Date of Patent: Oct. 15, 2002

(54) METHOD AND SYSTEM FOR TABBING FOLDED MATERIAL

(75) Inventors: Paul R. Sette, Branford; Richard A. Sloan, Jr., Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/442,552

(22) Filed: Nov. 18, 1999

(51) Int. Cl.[7] ..... B32B 31/04

(52) U.S. Cl. ..... 156/256; 156/264; 156/269; 270/58.31

(58) Field of Search ..... 156/483, 522, 156/204, 216, 227, 250, 256, 361, 441.5, 442.2, 484, 485, 264, 269; 270/58.31; 414/789.5

(56) References Cited

U.S. PATENT DOCUMENTS

| | | | | |
|---|---|---|---|---|
| 1,813,476 A | | 7/1931 | Waterworth | 493/419 |
| 2,594,316 A | | 4/1952 | Krueger et al. | 216/23 |
| 3,265,382 A | | 8/1966 | Sherman | 270/45 |
| 3,436,294 A | | 4/1969 | Marano | 156/351 |
| 3,527,635 A | | 9/1970 | Paulsen et al. | 156/361 |
| 3,535,186 A | | 10/1970 | De La Coussaye | 156/355 |
| 4,003,780 A | | 1/1977 | Cohn | 156/519 |
| 5,082,272 A | | 1/1992 | Xydias et al. | 271/186 |
| 5,088,712 A | * | 2/1992 | Luperti | 270/95 |
| 5,192,389 A | | 3/1993 | Martin | 156/364 |
| 5,196,083 A | | 3/1993 | Baker et al. | 156/364 |
| 5,279,698 A | | 1/1994 | Davis | 156/483 |
| 5,281,296 A | * | 1/1994 | Beliveau | 156/542 |
| 5,310,174 A | | 5/1994 | Thomas | 271/225 |
| 5,338,387 A | | 8/1994 | Noll | 156/441.5 |
| 5,417,783 A | | 5/1995 | Boreali et al. | 156/64 |
| 5,441,244 A | | 8/1995 | Bartoes et al. | 270/45 |
| 5,449,166 A | | 9/1995 | Lohmann et al. | 271/225 |
| 5,482,593 A | | 1/1996 | Kuhn et al. | 156/521 |
| 5,514,066 A | | 5/1996 | Monaco | 493/25 |
| 5,520,603 A | | 5/1996 | Bluthardt et al. | 493/421 |
| 5,547,175 A | | 8/1996 | Graushar et al. | 270/37 |
| 5,690,325 A | | 11/1997 | Morimoto | 271/65 |
| 5,711,846 A | | 1/1998 | Alicea | 156/556 |
| 5,735,101 A | | 4/1998 | Shing-Tak Lam | 53/136.1 |
| 5,768,959 A | | 6/1998 | Lorenzo | 83/74 |
| 5,769,774 A | | 6/1998 | Beck et al. | 493/421 |
| 5,785,638 A | | 7/1998 | Bristo et al. | 493/420 |
| 5,802,808 A | | 9/1998 | Lyga | 53/381.5 |
| 5,813,327 A | | 9/1998 | Freeman et al. | 101/93 |

(List continued on next page.)

OTHER PUBLICATIONS

U.S. Patent application Ser. No. 09/442,561, entitled "A Method and System for Folding and Tabbing Sheets", filing date: Nov. 18, 1999.

*Primary Examiner*—Richard Crispino
*Assistant Examiner*—Cheryl N. Hawkins
(74) *Attorney, Agent, or Firm*—Ronald Reichman; Angelo Chaclas

(57) ABSTRACT

A method and apparatus for tabbing a piece of folded material with one or more tape feeders mounted on the apparatus. The tape feeder includes a roll of tape, a transporting mechanism for advancing the tape in order to release a fixed length section of the tape, wherein the released section partially extends below the traveling path of the folded material with the adhesive side facing the leading edge of the folded material, a V-shaped knife positioned above the traveling path and downstream from the released tape section, wherein the apparatus further comprises a moving mechanism to move the folded material further downstream so as to cause the released section of tape to contact and fold over the leading edge of the folded material. As the folded material moves further downstream, the released section of tape is separated by the V-shaped knife to form a tab. A pair of sealer rollers located further downstream are used to firmly press the tab across the leading edge of the folded material.

12 Claims, 11 Drawing Sheets

FOREIGN PATENT DOCUMENTS

| | | | | |
|---|---|---|---|---|
| 5,816,570 | A | | 10/1998 | Paradis et al. ..... 271/179 |
| 5,816,715 | A | | 10/1998 | Harman et al. ..... 400/71 |
| 5,818,724 | A | | 10/1998 | Brewster, Jr. et al. .. 364/478.08 |
| 5,833,232 | A | | 11/1998 | Ifkovits et al. ..... 271/225 |
| 5,887,868 | A | | 3/1999 | Lambert et al. ..... 271/186 |
| 6,006,210 | A | * | 12/1999 | Freeman et al. ..... 705/402 |
| 6,090,034 | A | * | 7/2000 | Jaksch ..... 493/478 |
| 6,206,817 | B1 | | 3/2001 | Sette et al. ..... 493/421 |
| 6,244,590 | B1 | | 6/2001 | Williams ..... 271/184 |
| 6,244,591 | B1 | | 6/2001 | Paulat ..... 271/225 |

* cited by examiner

METHOD AND SYSTEM FOR TABBING FOLDED MATERIAL

CROSS REFERENCE TO RELATED APPLICATIONS

Reference is made to application Ser. No. 09/442,559, entitled METHOD AND SYSTEM FOR DIRECTING AN ITEM THROUGH THE FEED PATH OF A FOLDING APPARATUS, assigned to the assignee of this application and filed on even date herewith.

Reference is made to application Ser. No. 09/442,561, entitled METHOD AND SYSTEM FOR FOLDING AND TABBING SHEETS, assigned to the assignee of this application and filed on even date herewith.

Reference is made to U.S. Pat. No. 6,206,817, entitled METHOD AND APPARATUS FOR FOLDING SHEETS, assigned to the assignee of this application and filed on even date herewith.

TECHNICAL FIELD

The present invention relates to a tabber, or an apparatus for sealing a piece of folded material with one or more adhesive tabs.

BACKGROUND OF THE INVENTION

A self-mailer is conventionally defined as a mailpiece without an envelope. The mailer contains one or more sheets of printed material, folded once or twice by a folding device into a smaller piece for mailing. The folded material has a folded end and an open end. The open end is usually sealed with one or more tabs before the self-mailer is sent to an addressee. In addition, it may be necessary to apply or print an address label and a postage stamp or indicia on the mailpiece for mailing.

Self-mailers are well-known in the art. For example, U.S. Pat. No. 5,711,846 (Alicea) discloses a self-mailing apparatus in which a feeder module is used to feed the folded material, a labeling mechanism is used to apply an address label on each self-mailer and a tabbing device is then used to put a tab on the open end of the folded material. Typically, the tabs that are used to seal the folded material are precut into individual pieces and arranged in a roll on a narrow strip of removable backing material. The removable backing material is also known as the release liner which is used to transport the tabs into position. The adhesive on the tabs can be on the side of the tab that faces the backing material or on the opposite side. As disclosed in U.S. Pat. No. 5,711,846, for the tabs that have adhesive facing the backing material, the tab must be partially separated from the backing material and the backing material be pulled away to expose the adhesive side of the tab in order for the tab to contact the open end of the folded material. In the tabbing process, folded material is transported from an upstream direction, one piece at a time, into the tabbing area where the tab is applied to the edge of the folded material. As the folded material is moving further toward the downstream direction, the tab is caused to adhere to and fold across the edge for securing the folded material. If the adhesive on the tab is on the side that is facing away from the backing material, then the backing material does not need to be partially peeled off to expose the adhesive before the tab is in contact with the folded material. However, after folded material is caused to move into the tabbing area to be sealed with the tab, it is moved back out of the tabbing area in the opposite direction, as disclosed in U.S. Pat. No. 5,279,698 (Davis).

The major disadvantage of the tabbing apparatus that uses precut tabs is that it must be equipped with means for placing the tab correctly in relation to the leading edge of the folded material. As disclosed in U.S. Pat. No. 5,711,846, a pair of optical sensors are used to detect the presence of a tab at the correct location by sensing an ink mark on the tab. Alternatively, a mechanical device including gears and sprockets is used to advance a predetermined amount of backing material in order to place a tab in the tabbing area. Such a mechanical device has been disclosed in U.S. Pat. No. 5,279,698 (Davis). Even with such a mechanical device, one must still have a monitoring device to ascertain that no error, accumulative or otherwise, occurs in the tab positioning.

It is advantageous and desirable to provide a method and an apparatus for tabbing a piece of folded material wherein the tabs are not precut and, therefore, there is no need for having a sensor or a mechanical device to ensure that the tab is positioned correctly over the edge of the folded material. Furthermore, it is desirable to provide a method and an apparatus for tabbing folded material wherein the tabs are not affixed to a removable backing material, thereby reducing the cost of the tabbing material.

SUMMARY OF THE INVENTION

The present invention provides an apparatus and a method for tabbing a piece of folded material incoming along a substantially horizontal traveling path from an upstream direction, wherein the folded material has a leading edge, a width, a lower side and an upper side, and wherein the tabbing assembly has a width. The apparatus comprises at least one tape feeder movably mounted on the tabbing assembly along the width thereof in order to seal the leading edge of the folded material at at least one tabbing location, wherein the tape feeder includes a roll of tape having a width, an adhesive side and an opposing non-adhesive side; a transporting mechanism for advancing the tape in order to release a section of the tape from above the traveling path of the folded material into the traveling path with the adhesive side facing the leading edge of the folded material, wherein the released section of the tape has a leading end and a trailing end such that the leading end extends below the traveling path and the trailing end is positioned above the traveling path, and wherein the released section of the tape is placed such that the width of the tape is substantially parallel to the leading edge of the folded material; and a cutting device placed adjacent to the non-adhesive side of the tape and above the released section of the tape. The apparatus further comprises a transport mechanism to move the folded material further downstream so as to cause the released section of the tape to contact with, adhere to and move downstream along with the leading edge of the folded material, wherein the moving of the released section of the tape downstream causes the released section of the tape to be separated from the respective roll of tape by the cutting device, thereby producing a tab adhering to the leading edge of the folded material; and a pressing mechanism to press the tab across the leading edge onto the upper side and lower side of the folded material.

Accordingly, the method of sealing a piece of the folded material at at least one tabbing location comprises the steps of: 1) providing for each tabbing location a roll of adhesive tape having an adhesive side and an opposing non-adhesive side; 2) advancing the tape from above the traveling path of the folded material so that a fixed length of the tape is released into the traveling path with the adhesive side facing the leading edge of the folded material, wherein the released fixed length of the tape is partially positioned below the traveling path and partially positioned above the traveling path; 3) moving the folded material further downstream along the traveling path so as to cause the leading edge of the folded material to contact the released fixed length of the tape; 4) separating the released fixed length of the tape from the roll of tape thereby producing a tab in order to allow the tab to move along with the leading edge of folded material downstream; and 5) pressing the tab from the non-adhesive side so as to provide a good contact between the tab and the folded material across the leading edge of the folded material. For a fuller understanding of nature and objects of the present invention, reference is made to the following description taken in conjunction with FIG. 1 through FIG. 7B.

DETAILED DESCRIPTION

Figure 1:
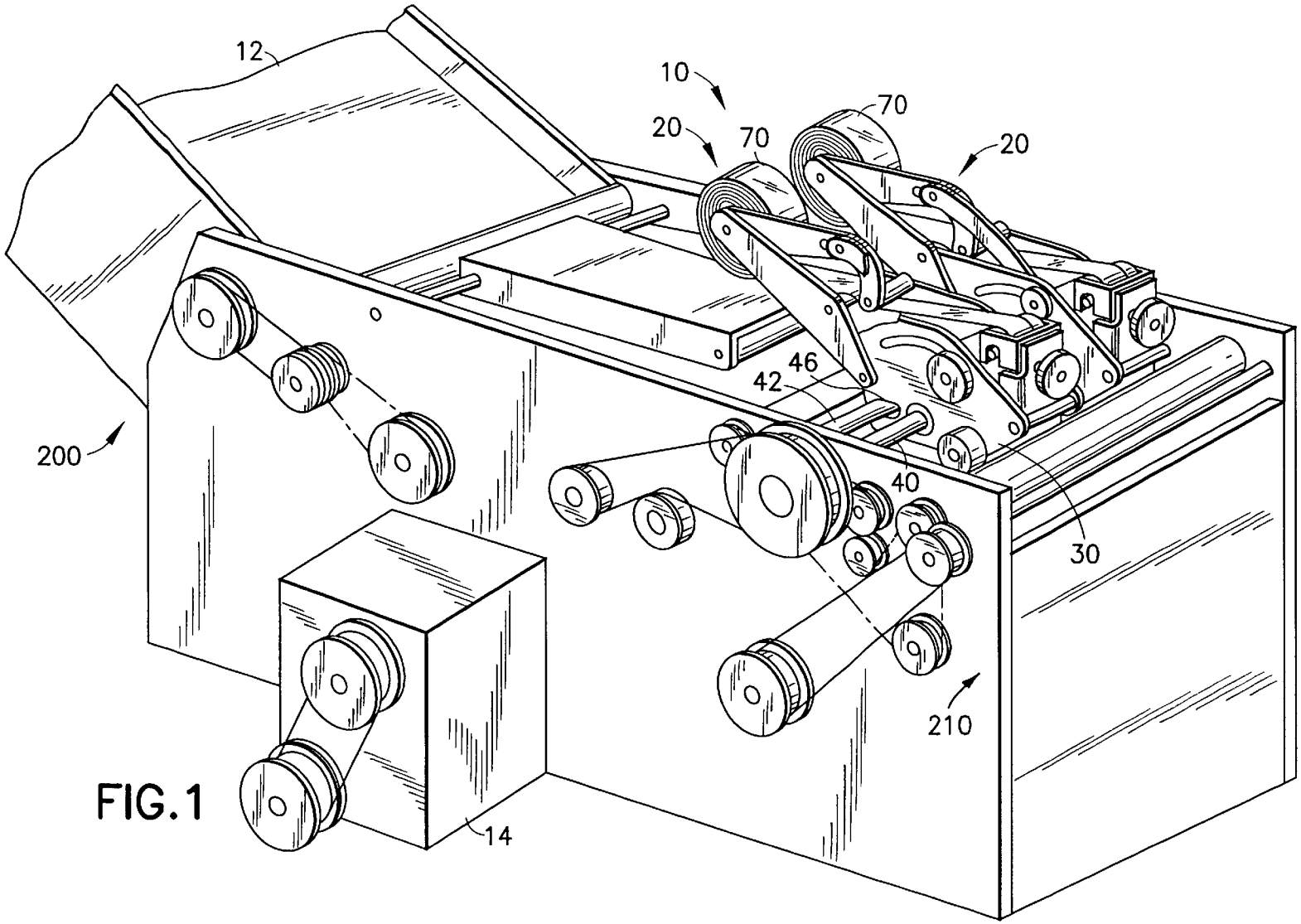
FIG. 1 is an isometric view of the tabbing apparatus, according to the present invention.

FIG. 1 is an isometric view of the tabbing apparatus 10, according to the present invention. As shown, the tabbing apparatus 10 includes two tape feeders 20 mounted at the downstream end 210 and a material feeder 12 mounted at the upstream end 200. The material feeder 12 is used to feed one piece of folded material 120 at a time (see FIG. 2) for tabbing. The tape feeders 20, each having a roll of tape 70, are used to supply tabbing material for sealing the folded material 120. Depending on the number of tabs 76 (see FIGS. 7A and 7B) to be put on a piece of folded material 120, the tabbing apparatus 10 can have one, two or more tape feeders 20. As shown in FIG. 1, two tape feeders 20 are adjustably mounted on a drive shaft 40 and a cam shaft 42. The tape feeders 20 are driven by a driving mechanism 14 to release the tape for tabbing Preferably, the drive shaft 40 is a spline, D or tri-lob type shaft. The cam shaft 42, which is mounted through a slot 46, is operable in a lock position to keep the tape feeders 20 in place, and a release position to allow the tape feeders 20 to be adjusted along the shafts 40 and 42, as described in conjunction with FIG. 2 below. The driving mechanism 14 may also be used to transport the fold material from the upstream end 200 to the downstream end 210 for tabbing.

Figure 2:
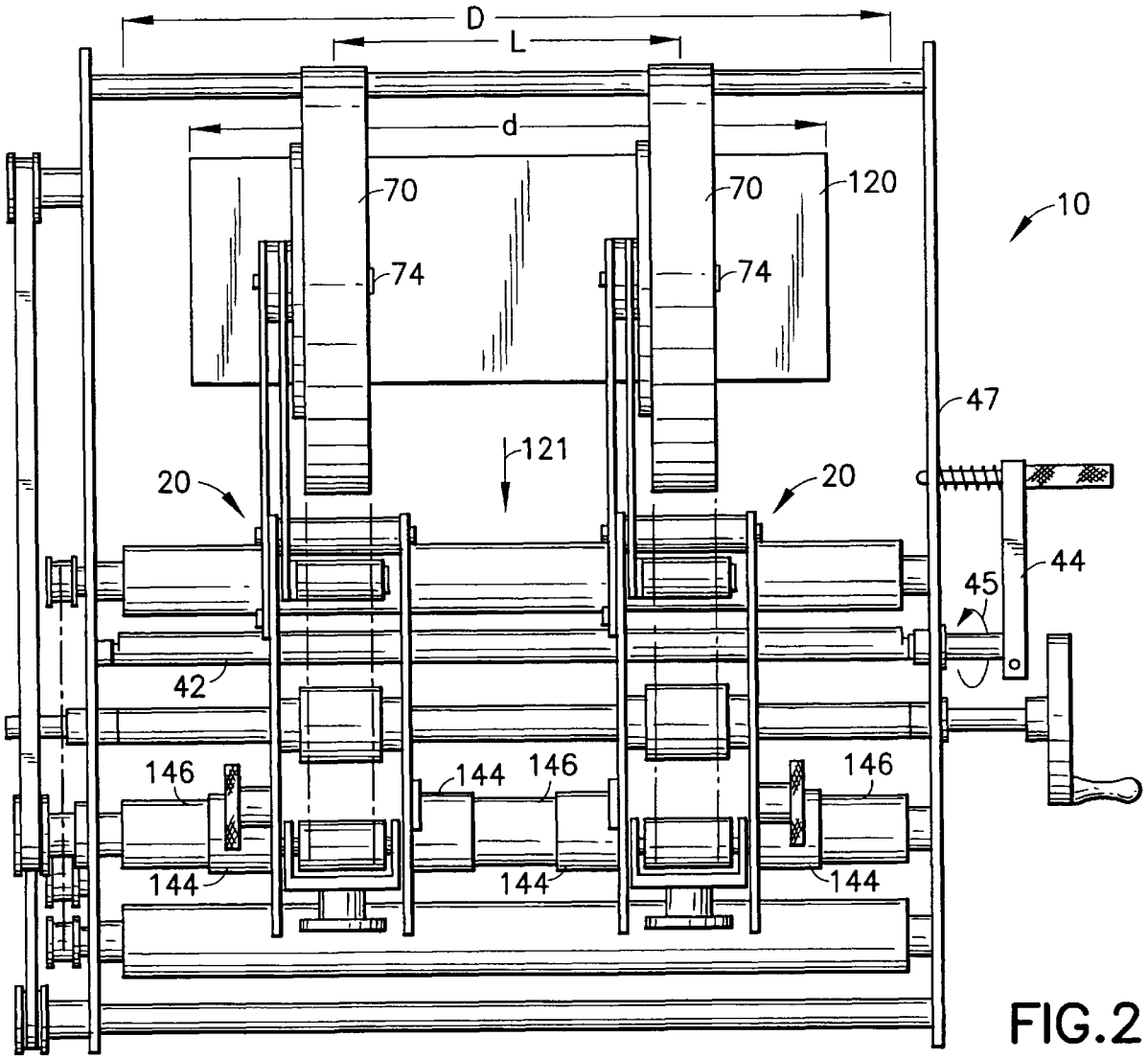
FIG. 2 is a top view of the tabbing apparatus of FIG. 1.

FIG. 2 shows the top view of the tabbing apparatus 10. As shown, the tabbing apparatus 10 has a width D to accommodate the different width d of the folded material 120, which is fed from the upstream end 200 of the tabbing apparatus 10 to traveling downstream in a direction indicated by arrow 121. The position of the tape feeders 20 along the drive shaft 40 and the cam shaft 42, and the distance L between the tape feeders 20, can be adjusted to suite the width d of the folded material 120.

Figure 3:
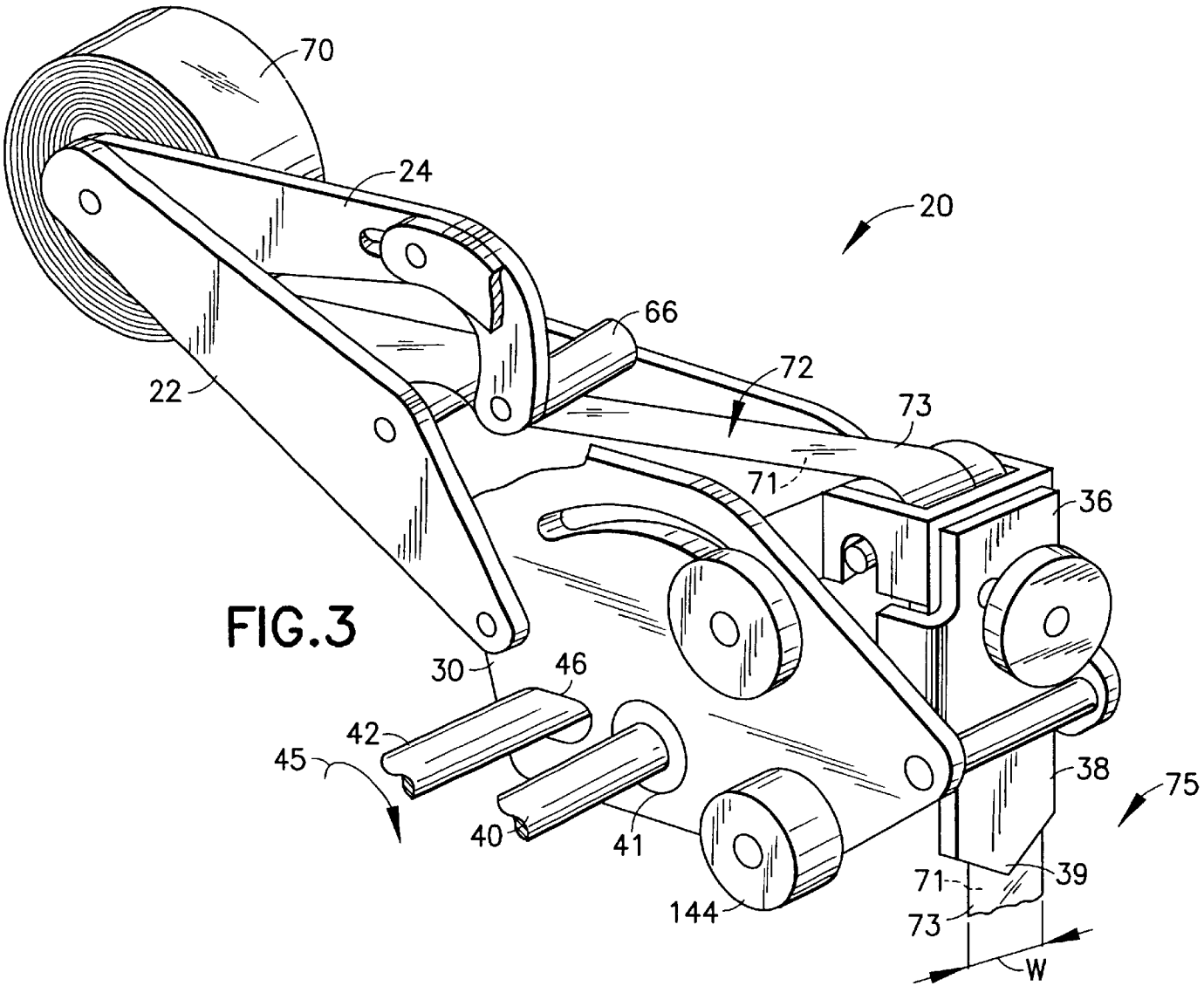
FIG. 3 is an isometric view of a tape feeder, according to the present invention.

The cam shaft 42 is an eccentric cylinder mounted through slot 46, as shown in FIGS. 1 and 3, is used to pitch the downstream end of the tape feeders 20 up and down. The cam shaft 42 is operable in a lock position and a release position. As shown in FIG. 2, the cam shaft 42 is operated in the lock position. Using a handle 44, the cam shaft 42 can be rotated in a counter-clockwise direction, as indicated by arrow 45, to cause the downstream end of the tape feeders 20 to pitch downward so that a pair of idler rollers 144 on each tape feeder 20 are caused to clamp down tightly onto a spring-loaded, driver roller 146. The handle 44 is then latched to a side panel 47 of the tabbing apparatus 10. Such clamping prevents the tape feeders 20 from sliding along the shafts 40 and 42. The cam shaft 42 is operated in the release position when the handle 44 is used to rotate the cam shaft 42 in a clockwise direction about 90 degrees in order to disengage the idlers rollers 144 from the drive roller 146. As such, the position of the tape feeders 20 along the shafts 40 and 42 can be adjusted. Also shown in FIG. 2 are two rolls of tape 70, each mounted on the mandrel 74 of a tape feeder 20.

In FIG. 3, there is shown a roll 70 of adhesive tape 72 rotatably mounted on a support arm 22 which is fixedly connected to a tape drive mount 30. A tensioner roller 66 is rotatably mounted on a tensioner arm 24 for adjusting the tension of tape 72. Tape 72 is fed through a tape guide 36 to provide the tabbing material. As shown, a small section 75 of the tape 72 extends from the tape guide 36 beyond a tape knife 38. This tape section 75 is separated from the rest of tape 72 by tape knife 38 to become a tab 76 for sealing a piece of folded material 120 (FIGS. 6D, 7A and 7B). Tape 72 has an adhesive side 71 and a non-adhesive side 73, with the non-adhesive side 73 facing the tape knife 38. The tape knife 38 has a V-shape blade with a pointed end 39 located centrally with the width W of the tape section 75. Also shown in FIG. 3 are a pair of idler rollers 44, a drive shaft 40, and a cam shaft 42 which is mounted through slot 46 on the tape drive mount 30, as described in conjunction with FIG. 2 above. An outboard journal 41, which supports bearings (not shown), is mounted on drive shaft 40 to allow drive shaft 40 to rotate while the tape drive mount 30 remains stationary.

Figure 4A:
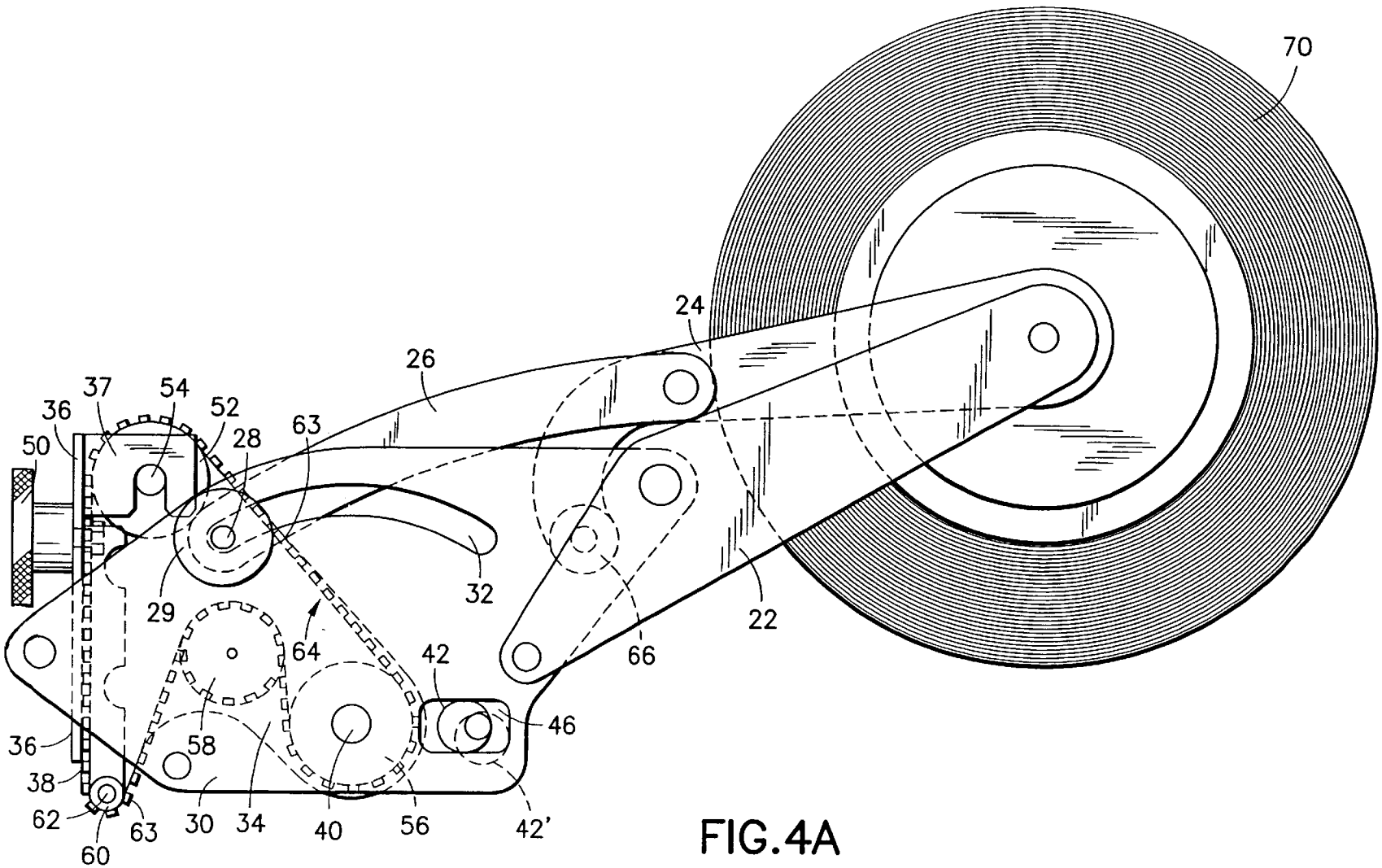
FIG. 4A is a side view of the tape feeder showing the operational position of the tape feeder.
Figure 4B:
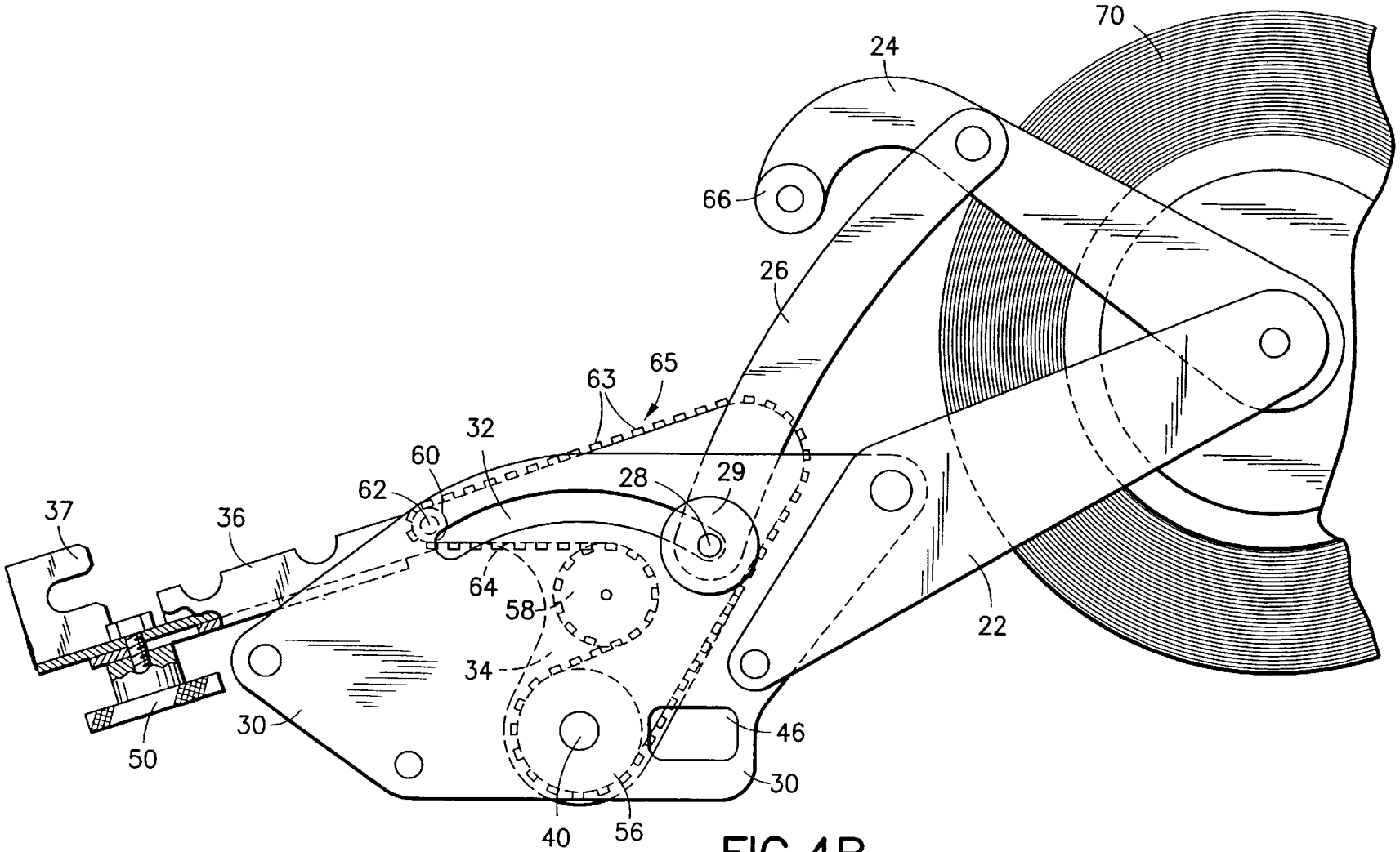
FIG. 4B is a side of view of the tape feeder showing the loading position of the tape feeder.

FIG. 4A shows the tape feeder 20 in an operational position. As shown, a tape transport assembly 34 is pivotally mounted on the tape drive mount 30 at pivot 40. A pin 28 on the tape transport assembly 34 and a curved slot 32 on the tape drive mount 30 allow the tape transport assembly 34 to swing forward when the tape feeder 20 is in the operational position as shown in FIG. 4A, and to swing backward when the tape feeder 20 is in the loading position as shown in FIG. 4B. Furthermore, an actuating arm 24 is pivotally mounted on the tensioner arm 24 and the tape transport assembly 34 to support the tape transport assembly 34. An assembly lock knob 29 is used to lock the tape transport assembly 34 in place. On the tape transport assembly 34, a transport belt having molded teeth 63 similar to a timing belt is used as an endless belt 64 looping around an upper roller 52, a drive roller 56 and a peel-off roller 60. As the molded teeth 63 are engaged with a time gear 58 for movement, the endless belt 64 transports the tape 72 behind the tape guide 36 toward the direction of the tape knife 38. The timing gear 58 is caused to turn by a pair of spur gears 57 and 59 as shown in FIG. 5.

The tape guide 36 is pivotably mounted on the tape transport assembly 34 at pivot 62 which is also serve as a shaft for mounting the peel-off roller 60. When the tape feeder 20 is in the operational position, as shown in FIG. 4A, an upper hook end 37 of the tape guide 36 is engaged with an upper shaft 54 of the upper roller 52. The tape guide 36 is secured by a lock knob 50.

When the assembly lock knob 29 is loosened, it allows the tape transport assembly 34 to swing backward toward the support arm 22 into the loading position, as shown in FIG. 4B. Furthermore, the lock knob 50 is loosened to allow the tape guide 36 to be moved away from the tape transport assembly 34. When the tape guide 36 is in this position, a section 65 of the endless belt 64 is exposed on the upper end of the tape drive mount 30. That allows the tape 72 from the tape roll 70 to be affixed onto the endless belt 64 as shown in FIG. 5. After loading, the tape guide 36 is again engaged to upper shaft 54 and locked in place by the lock knob 50. The tape transport assembly 34 is then swung forward and locked in place by the assembly lock knob 29 into the operational position.

Figure 5:
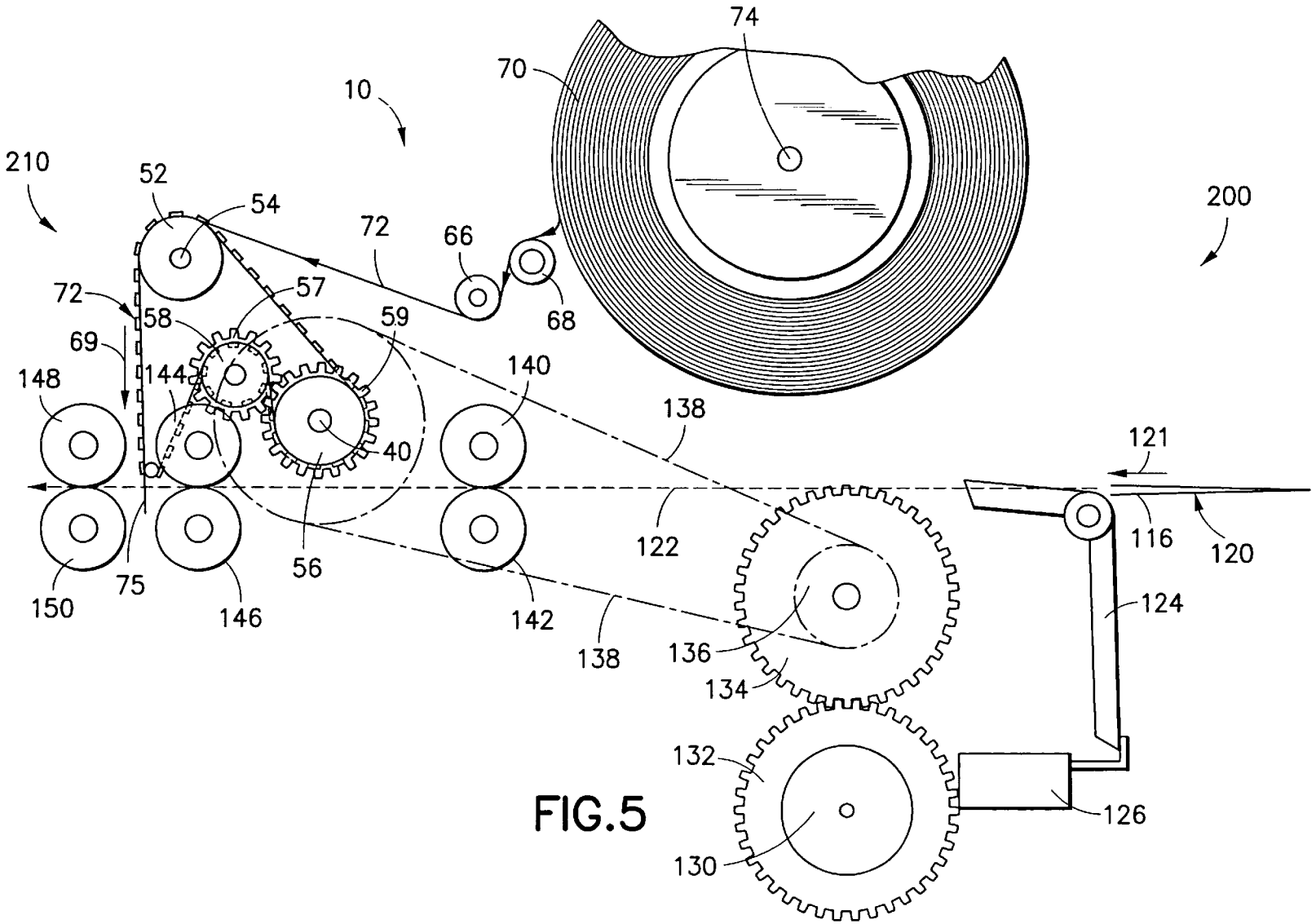
FIG. 5 is a schematic diagram of the side view of the tabbing apparatus showing the feeding path of the tape relative to the traveling path of a piece of folded material in the tabbing operation.

The path of tape 72 in the tabbing apparatus 10 is shown in FIG. 5. As shown, tape 72 from the roll of tape 70 is looped over a first roller 68 to the endless belt 64, starting from the upper roller 52 to the peel-off roller 60. From the upper roller 52 to the peel-off roller 60, the tape 72 is in contact with the molded teeth 63 (see FIG. 4A) of the endless belt 64 for movement. Preferably, the peel-off roller 60 has a very small diameter to produce a sharp turn for the endless belt 64 as the endless belt 64 is looped through the timing gear 58. The sharp turn of the endless belt 64 around the peel-off roller 60 causes the tape 72 to peel off from the endless belt 64. Thus, when the tape 72 is further advanced by the endless belt 64, along a direction 69 the tape 72 moves across the traveling path 122 of the folded material 120.

As shown in FIG. 5, the timing gear 58 is fixedly connected to a spur gear 57 which meshes with another spur gear 59 connected to the drive roller 56. The drive roller/spur gear assembly 56/59 is driven by a drive belt 138 and a main drive roller 136. The main drive roller 136, fixedly attached to a spur gear 134, is caused to rotate by another spur gear 132 which is attached to a single revolution clutch 130. The clutch 130 controls the movement of the spur gear 132 such that whenever the clutch 130 is released from a latched position, it allows the spur gear 132 to complete a single revolution. Normally the clutch 130 is latched by a latching mechanism 126 to prevent the tape 72 from advancing, but the clutch 130 can be released by a trip release mechanism 124. Trip release mechanism 124 is placed in the traveling path 122 to be tripped by an incoming piece of folded material 120. When that happens, the clutch 130 is released and the endless belt 64 is caused to move a fixed distance. Consequently, the tape feeder 20 releases a fixed length of tape 72 into the traveling path 122. The released section of tape 72 can be adjusted by adding a variable ratio drive, which is not shown, between the main drive roller 136 and driver roller 56. It is also possible that a position controlled drive motor be used to control the drive shaft 46. This will allow a different length of tape to be used for sealing a piece of folded material, depending on the thickness of the folded material.

Also shown in FIG. 5 are two rollers 140 and 142 for moving the folded material 120 further downstream, idler roller 144 and drive roller 146 for moving the folded material 120 into the tabbing location where the leading edge 116 of the folded material 120 contacts the released tape section 75, and a pair of sealer rollers 148, 150 for securing the tab onto the folded material 120 as shown in FIG. 6D.

Figure 6A:
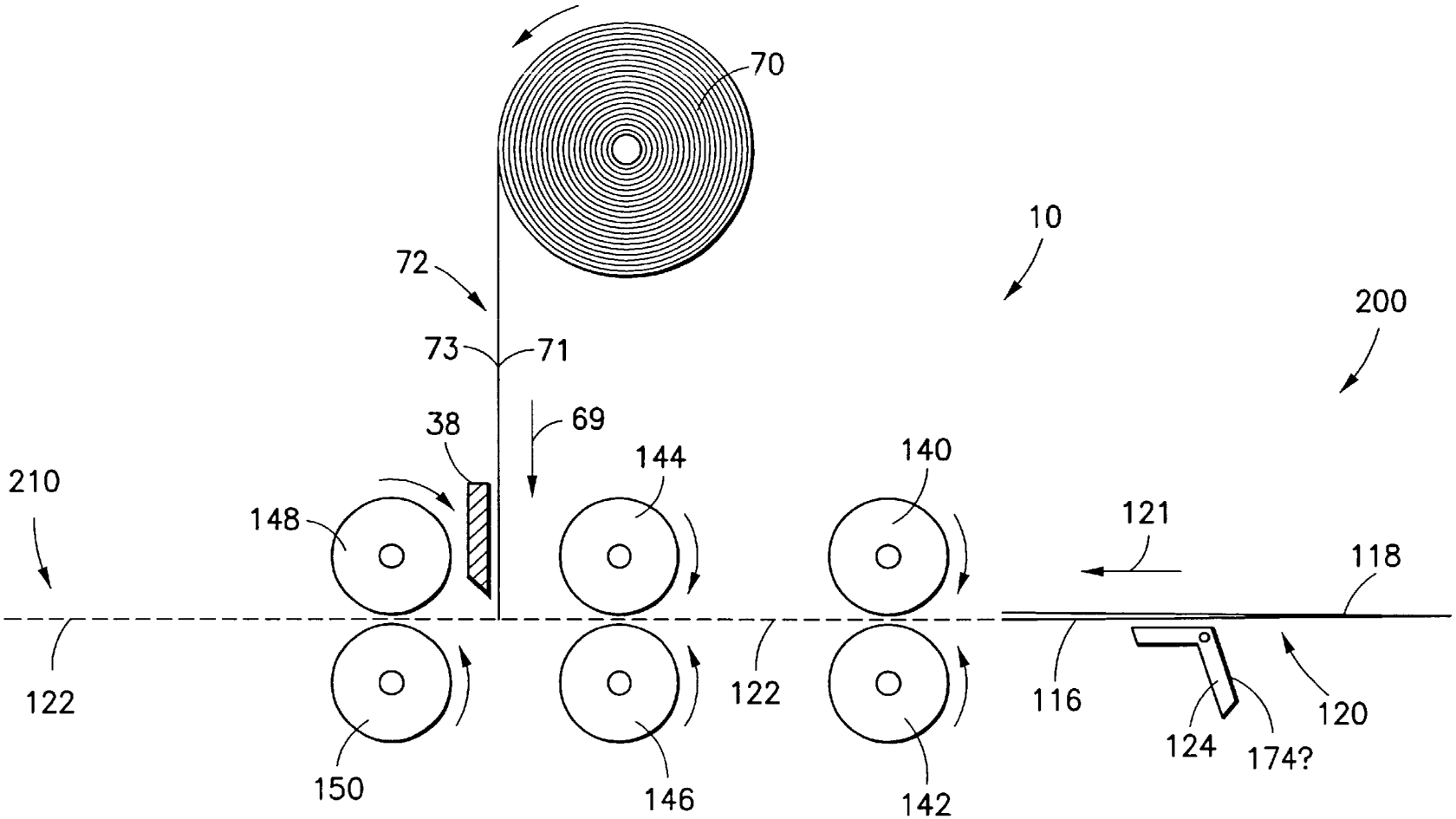
FIGS. 6A through 6D are schematic diagrams for showing the principle of the tabbing operation.
Figure 6B:
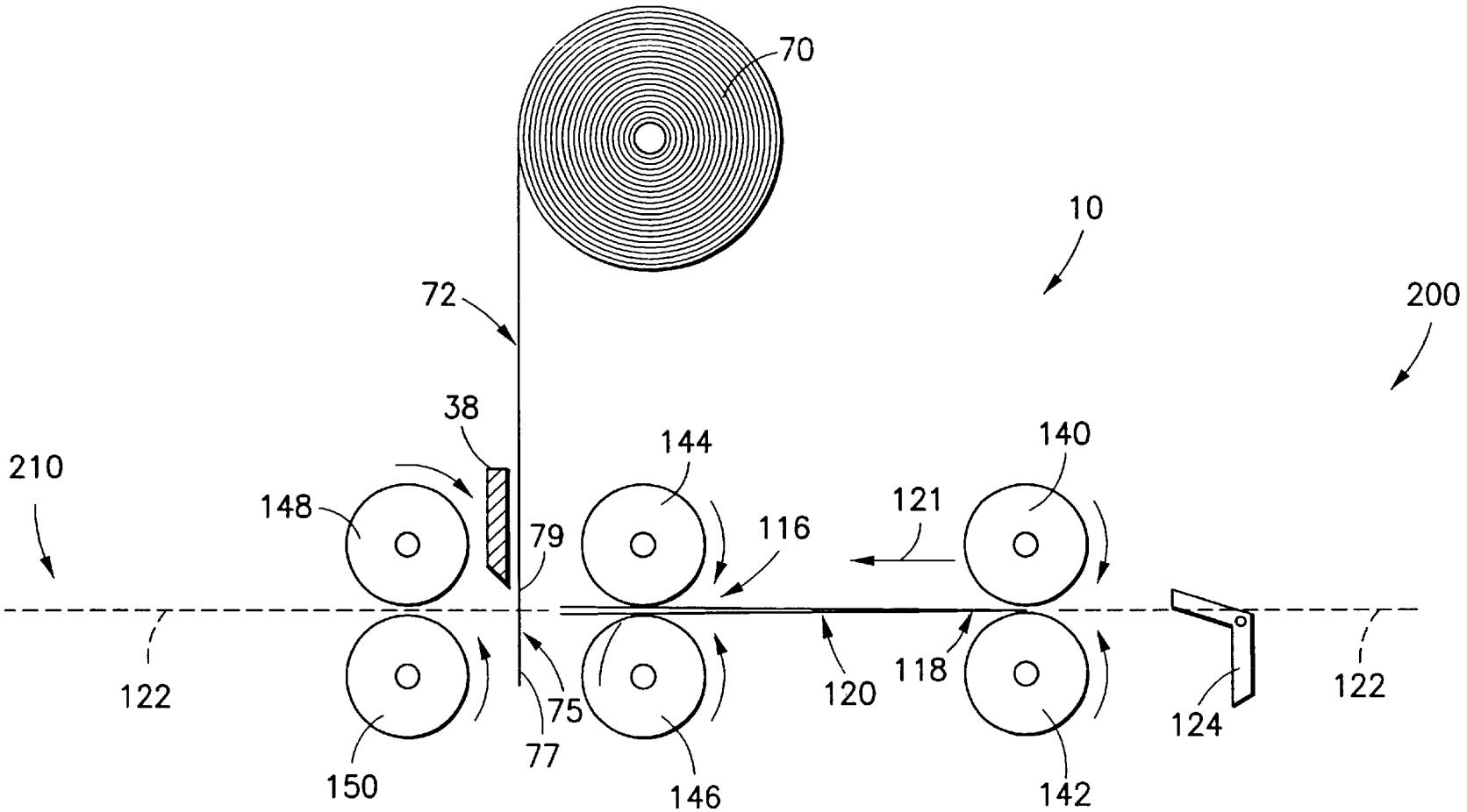
Figure 6C:
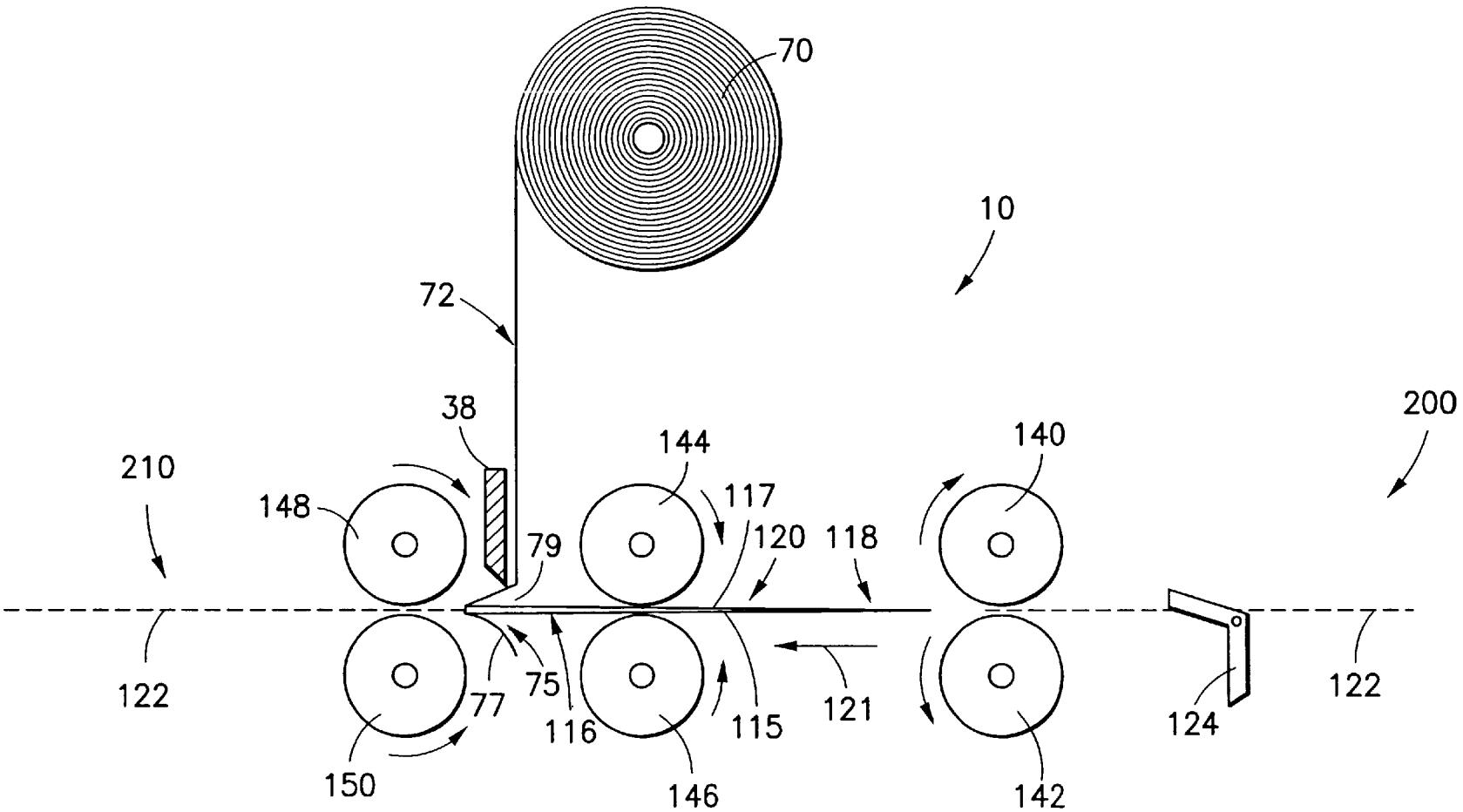
Figure 6D:
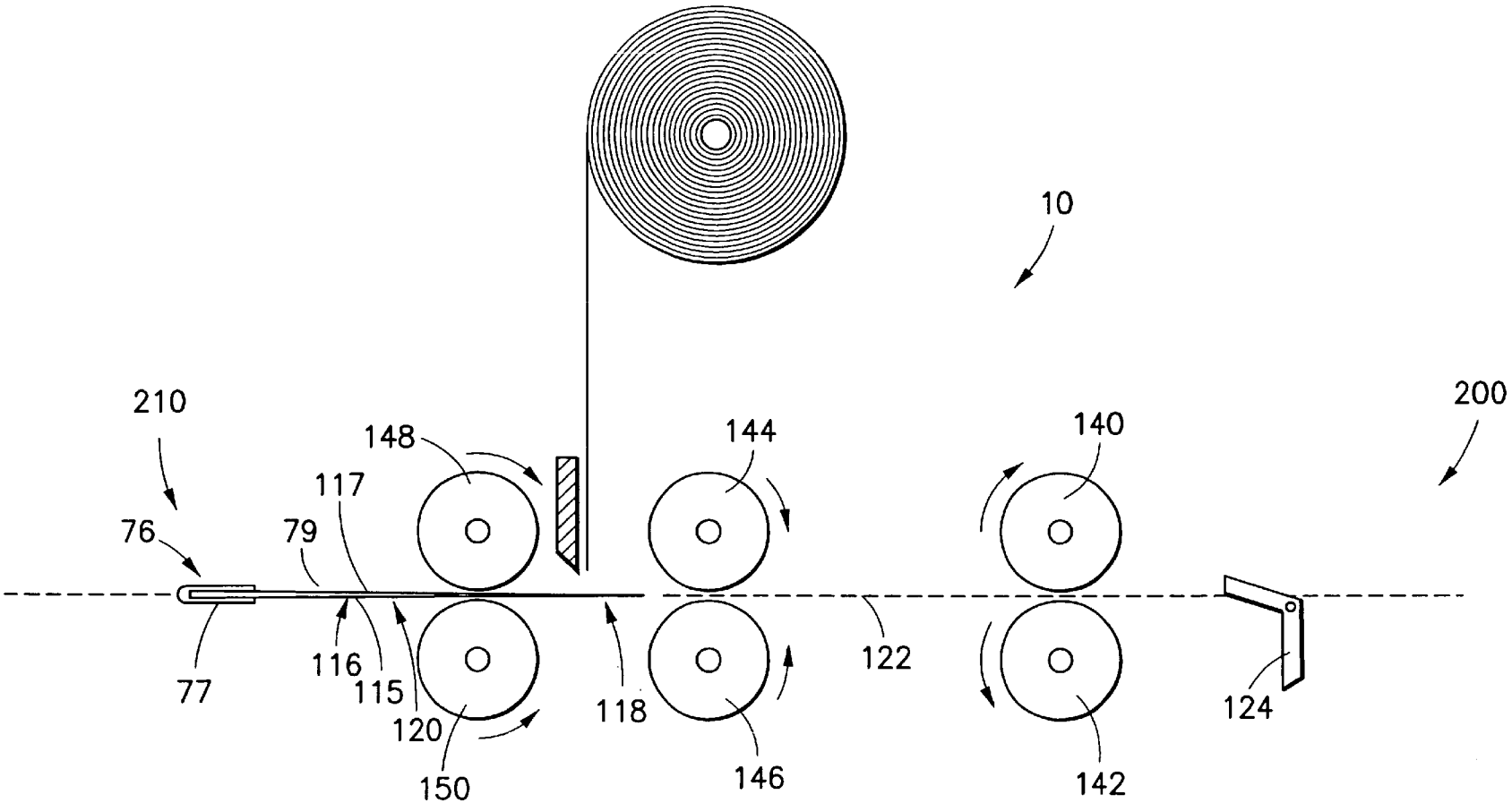
Figure 7A:
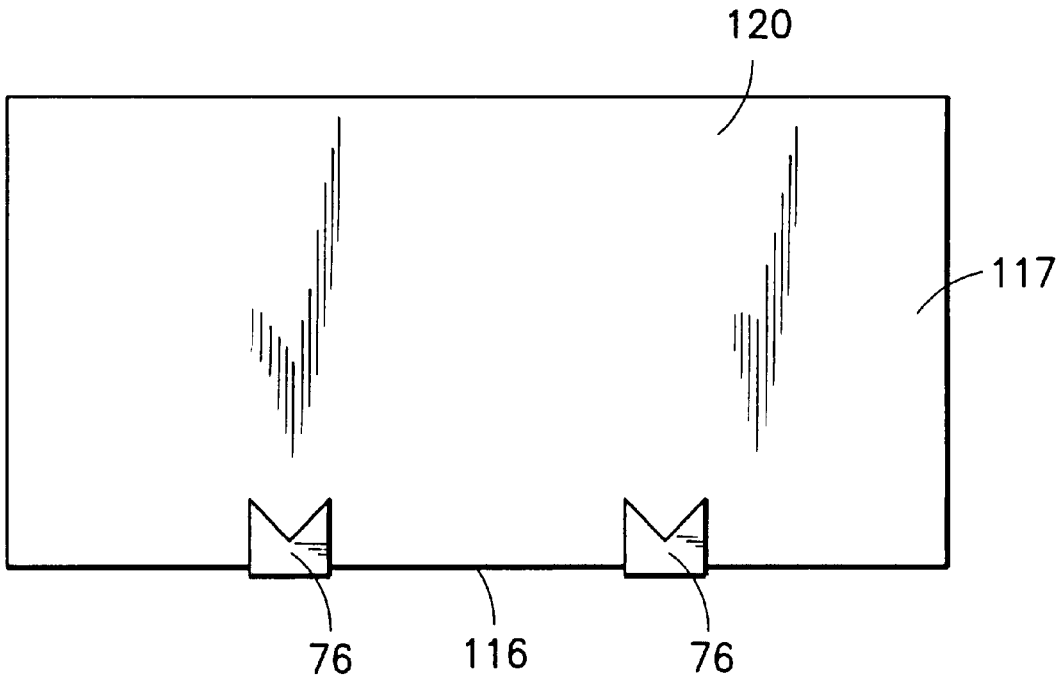
FIG. 7A is the top view of a self-mailer sealed with two tabs.
Figure 7B:
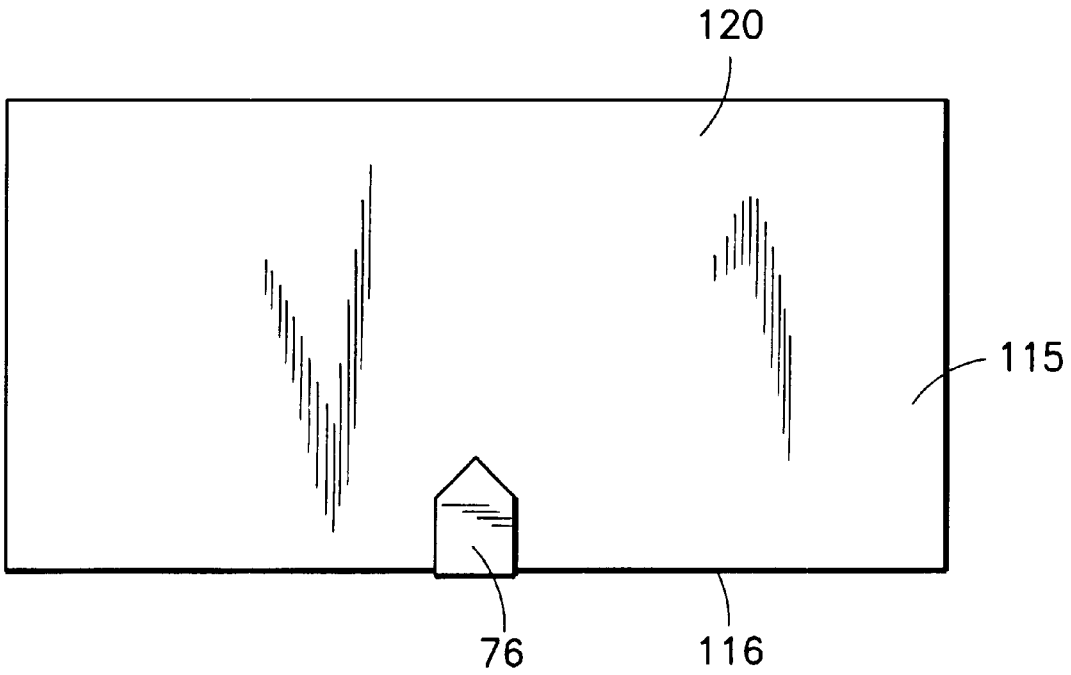
FIG. 7B is the bottom view of a self-mailer sealed with one tab.

FIGS. 6A through 6D illustrate the principle of the tabbing operation. In FIG. 6A, there is shown a piece of folded material 120 moving along path 122 from upstream direction 200. Folded material 120 has an open end 116 leading a folded end 118. When folded material 120 trips the trip release mechanism 124, it causes tape 72 to move along the direction 69 from above the traveling path 122 of the folded material 120 into the traveling path 122. As shown, the adhesive side 71 of tape 72 faces the leading edge 116 of the folded material 120, and the non-adhesive side 73 faces the tape knife 38.

Only a fixed length of tape 72 is released beyond the tape knife 38 into the traveling path 122, responsive to each tripping of the trip release mechanism 124. The released tape section is denoted by reference numeral 75. As shown in FIG. 6B, the leading end 77 of the released tape section 75 extends below the traveling path 122 while the trailing end 79 is positioned above the traveling path 122.

As the folded material 122 is moved by idler roller 144 and drive roller 146 into the released tape section 75, it causes the released tape section 75 to fold across the leading edge 116 of the folded material 122. The released tape section 75 is dragged into the nip formed by sealer rollers 148 and 150, as shown in FIG. 6C. Consequently, the leading end 77 of the released tape section 75 starts to seal the bottom side 115 of the folded material 120 while the trailing end 79 seals the top side 117. As the released tape section 75 is stretched across the V-shaped tape knife 38, it is pierced and torn by the tape knife 38.

Consequently, the released tape section 75 is separated from the tape 72 that is trapped by the endless belt 64 and tape guide 36 (FIG. 4A). The separated tape section 75 becomes a tab 76 as shown in FIG. 6D. When the leading edge 116 of the folded material 120 is moved pass the sealer rollers 148 and 150, the tab 76 is firmly pressed by rollers 148, 150 to seal the leading edge 116 of the folded material 120.

The tabbing apparatus 10 as shown in FIGS. 1 and 2 has two tape feeders 20, each of which applies a tab 76 on a piece of folded material 120. Accordingly, the folded material 120 is tabbed at two separate locations on the leading edge 116 as shown FIG. 6A. FIG. 6A shows the top view of a piece of folded material 120 sealed with two tabs 76 across the leading edge 116. The V-shape at the end of the tabs is resulted from the V-shaped edge of the tape knife 38. It is possible that one or three or more tape feeders 20 can be mounted on the tabbing apparatus 10 to provide a corresponding number of tabs 76 on the folded material 120. FIG. 7B illustrates the bottom view of a piece of folded material 120 sealed with one tab 76.

Although the invention has been described with respect to a preferred version and embodiment thereof, it will be understood by those skilled in the art that the foregoing and various other changes, omissions and deviations in the form and detail thereof may be made without departing from the spirit and scope of this invention.

What is claimed is:

1. A method of sealing a piece of folded material incoming along a substantially horizontal traveling path from an upstream direction toward a downstream direction, wherein the folded material has a leading edge, a lower side and an upper side, said method comprising the steps of:

(a) providing a supply of tabbing material in a continuous length, wherein said tabbing material has a width, an adhesive side and an opposing non-adhesive side;

(b) advancing the supply of tabbing material to release a section of the tabbing material from above the traveling path into the traveling path with the adhesive side facing the leading edge of the folded material, wherein the released section of the tabbing material has a leading end and a trailing end such that the leading end extends below the traveling path and the trailing end is positioned above the traveling path, and wherein the released section of the tabbing material is placed substantially in a vertical orientation with the width of the tabbing material being substantially parallel to the leading edge of the folded material;

(c) moving the folded material further downstream so as to cause the leading edge of the folded material to contact the released section of the tabbing material;

(d) separating the released section of the tabbing material from the supply at the trailing end with a cutting device with a V-shaped edge having a pointed end located adjacent to the traveling path substantially at a midpoint of the width of the tabbing material in order to allow the released section of the tabbing material to move along with the leading edge of the folded material downstream; and (e) pressing the released section of the tabbing material from the non-adhesive side onto the leading edge of the folded material so as to secure the released section of the tabbing material on the folded material.

2. The method of claim 1, wherein the released section of the tabbing material has a substantially fixed length.

3. The method of claim 1, wherein the advancing of the tabbing material to release a section of the tabbing material is controlled by a single-revolution clutch.

4. The method of claim 3, wherein the single-revolution clutch for controlling the advancing of the tabbing material is actuated by a trip mechanism responsive to the incoming of the folded material.

5. The method of claim 1, wherein the supply of tabbing material comprises a roll of adhesive tape.

6. The method of claim 1, wherein the advancing of the tabbing material is carried out by an endless belt looping around a plurality of rollers.

7. The method of claim 6, wherein the endless belt is a timing belt which is caused to advance by a time gear.

8. A method of sealing an item incoming along a substantially horizontal traveling path from an upstream direction toward a downstream direction, wherein the item has a leading edge, a lower side and an upper side, said method comprising the steps of:

(a) providing a roll of adhesive tape having an adhesive side and an opposing non-adhesive side;

(b) advancing the tape from above the traveling path so that a section of the tape is released into the traveling path of the item with the adhesive side facing the leading edge of the item, wherein the released section of the tape is partially positioned below the traveling path and partially positioned above the traveling path;

(c) moving the item further downstream along the traveling path so as to cause the leading edge of the item to contact the released section of the tape;

(d) separating the released section of the tape from the roll of tape with a cutting device with a V-shaped edge having a pointed end located adjacent to the traveling path substantially at a midpoint of the width of the tabbing material in order to produce a tab and allow the tab to move along with the leading edge of item downstream; and (e) pressing the tab so as to secure the tab on the item.

9. The method claimed in claim 1, further including the step of:

providing additional supplies of tabbing material in continuous lengths, wherein said additional tabbing materials have a width, an adhesive side, and a opposing non-adhesive side.

10. The method claimed in claim 9, wherein each additional supply of tabbing material will have the released section of the tabbing material on the folded material when the additional supplies of tabbing material are pressed.

11. The method claimed in claim 9, further including the step of:

adjusting the position of additional supplies of tabbing material to control the spacing of the tabbing material on the folded material.

12. The method claimed in claim 11, further including the step of:

adjusting the position of the supply in step (a) to control the spacing of the tabbing material on the folded material.

* * * * *